US007866655B2

(12) United States Patent
Uehara

(10) Patent No.: US 7,866,655 B2
(45) Date of Patent: Jan. 11, 2011

(54) IMAGE FORMING APPARATUS

(75) Inventor: Masakazu Uehara, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/400,054

(22) Filed: Mar. 9, 2009

(65) Prior Publication Data

US 2009/0230610 A1 Sep. 17, 2009

(30) Foreign Application Priority Data

Mar. 11, 2008 (JP) ..... 2008-060536

(51) Int. Cl.
*B65H 3/44* (2006.01)
*B65H 5/26* (2006.01)

(52) U.S. Cl. ..... 271/9.09; 399/392

(58) Field of Classification Search ..... 271/9.09, 271/127, 162; 399/392
See application file for complete search history.

(56) References Cited

U.S. PATENT DOCUMENTS 5,573,235 A * 11/1996 Asai ..... 271/121
7,303,190 B2 * 12/2007 Yamanaka et al. ..... 271/162
7,444,112 B2 * 10/2008 Murakami et al. ..... 399/392
7,484,722 B2 * 2/2009 Ishii ..... 271/9.09
7,611,138 B2 * 11/2009 Fujita et al. ..... 271/9.09
2006/0082044 A1 * 4/2006 Aida ..... 271/145
2007/0045943 A1 3/2007 Shibayama

FOREIGN PATENT DOCUMENTS

JP 2007-62917 3/2007
JP 2007-62966 3/2007

* cited by examiner

*Primary Examiner*—Kaitlin S Joerger
(74) *Attorney, Agent, or Firm*—Gerald E. Hespos; Michael J. Porco

(57) ABSTRACT

An image forming apparatus includes an apparatus main body provided with an opening, an image forming unit attachable to and detachable from the apparatus main body via the opening, a cover supported pivotally on the apparatus main body so as to cover the opening, and a sheet feeding unit disposed below the opening. The sheet feeding unit includes a sheet storing portion that is supported pivotally on the apparatus main body for stacking sheets thereon, a sheet feeding roller that feeds a sheet toward inside the apparatus main body, and a housing that supports the sheet feeding roller thereon in a rotatable manner. The cover has a housing supporting portion that abuts on the housing from above the housing when the cover is in a closed state.

6 Claims, 6 Drawing Sheets

IMAGE FORMING APPARATUS

BACKGROUND OF THE INVENTION

1. Field of the Invention

The present invention relates to an image forming apparatus represented by a copying machine, a printer, and a facsimile machine.

2. Description of the Related Art

An image forming apparatus includes a sheet feeding cassette that can be pulled out from the apparatus main body and a manual tray (multi-purpose tray) can be opened and closed. A large number of frequently used standard sheets are stacked in the sheet feeding cassette. The standard sheets are separated one by one and fed toward a registration roller from the sheet feeding cassette.

Meanwhile, the manual tray is formed so that not only standard sheets but also special sheets, such as thick paper and post cards, can be stacked thereon. The sheets which are fed by manual operation are also separated one by one and sent toward the registration roller from the tray (see, for example, JP-A-2007-62917 and JP-A-2007-62966).

More specifically, when the manual tray is opened, a lifting plate provided to the tray abuts on a sheet feeding roller. A sheet is then manually placed on the tray. When the start button of the image forming apparatus is pressed, the sheet is nipped in a sheet feeding nip portion formed by the sheet feeding roller and the lifting plate that are pressed against each other. A feeding force is thus given to the sheet so that it is fed toward the registration roller.

Incidentally, there is a case where an opening is formed above the sheet feeding roller in the front side of the image forming apparatus facing the operator. For example, an image forming unit can be pulled out from the apparatus main body through this opening. It is therefore necessary for the image forming apparatus of this type to secure a space for the opening.

Meanwhile, the sheet feeding roller is supported on a multi-frame made of resin in a rotatable manner. Herein, when a pressure from the lifting plate acts on the sheet feeding roller, the multi-frame undergoes a deflection in a direction to escape from the lifting plate, which raises a problem that an appropriate sheet feeding force cannot be obtained. This problem can further cause jamming of the sheet at somewhere between the sheet feeding roller and the registration roller.

In order to solve this problem, the rigidity of the multi-frame may be enhanced with a reinforcing member, which is a separate member from the multi-frame, by attaching it to the multi-frame. According to this method, however, in pulling out a unit from the apparatus main body, a reinforcing structure interferes, and the operability worsens. In addition, because the number of components and the number of fabrication steps are increased, there arises another problem that the apparatus cannot be made cheaper.

SUMMARY OF THE INVENTION

An object of the invention is to provide an image forming apparatus capable of solving the problems above and thereby obtaining an appropriate sheet feeding force while making the apparatus cheaper and easier to operate.

An image forming apparatus according to an aspect of the invention that achieves the above and other objects includes: an apparatus main body provided with an opening; an image forming unit for forming an image while being attachable to and detachable from the apparatus main body via the opening; a cover supported pivotally on the apparatus main body so as to cover the opening; and a sheet feeding unit disposed below the opening, including a sheet storing portion supported pivotally on the apparatus main body for stacking sheets thereon, lifting plate held in the sheet storing portion to be movable up and down, a sheet feeding roller pressed against the lifting plate and feeding a sheet on the sheet storing portion toward inside the apparatus main body, and a housing on which to support the sheet feeding roller in a rotatable manner. The cover has a housing support portion that abuts on the housing from above the housing when the cover is in a closed state.

DETAILED DESCRIPTION OF THE PREFERRED EMBODIMENT

Hereinafter, one embodiment of the present invention will be described with reference to the drawings.

Figure 1:
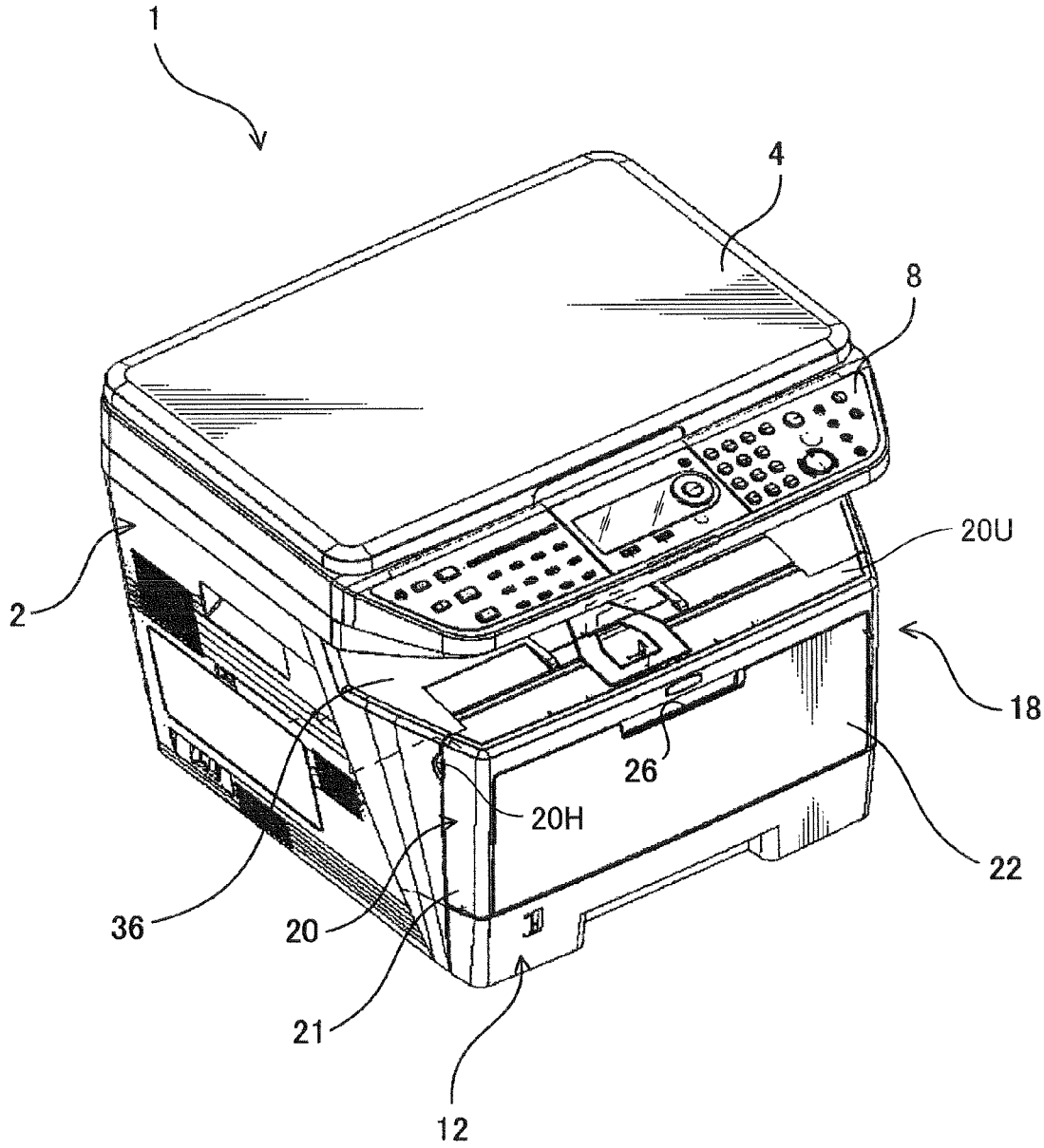
FIG. 1 is an outward perspective view of an image forming apparatus according to one embodiment of the invention.

FIG. 1 is a perspective view of a MFP (Multifunction printer) 1, which is an example of an image forming apparatus according to one embodiment of the present invention, when viewed from above on the frontal left. It illustrates the front of the MFP 1 facing the operator and the left side of the MFP 1. The MFP 1 includes an apparatus main body 2, and a sheet discharging tray 36 of an internal discharge type is formed on the inside of the apparatus main body 2.

Figure 6A:
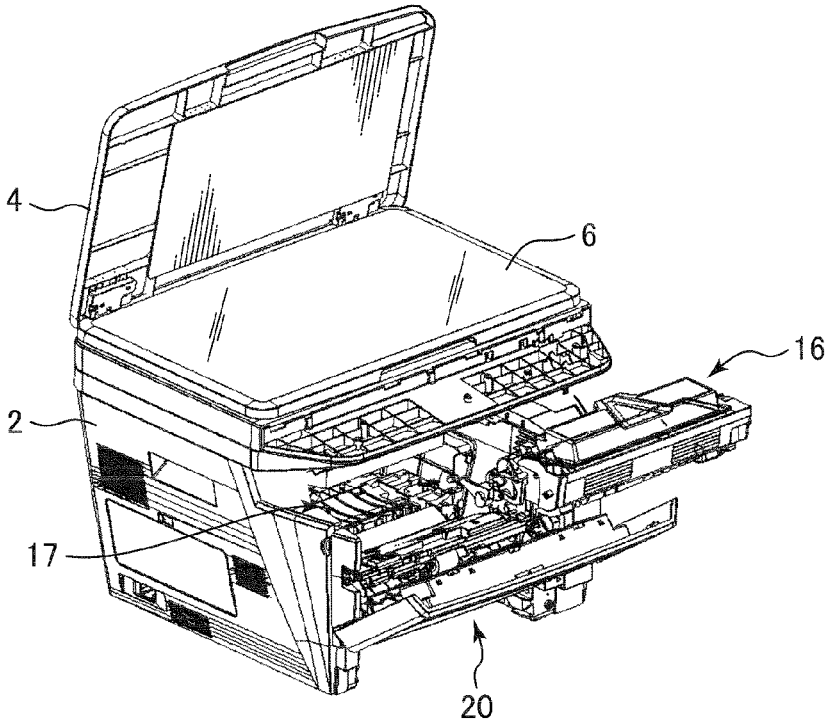
FIG. 6A is a perspective view showing a state where a front cover is opened and FIG. 6B is an enlarged view of a major portion thereof.

A platen cover 4 is disposed on the top of the apparatus main body 2 and a contact glass 6 is disposed beneath the platen cover 4 (see FIG. 6A). Image data of a document placed on the contact glass 6 is read optically by a scanner portion 7 (see FIG. 2). An ADF (Automatic Document Feeder) for transporting a document to the predetermined image reading position may be mounted on the top instead of the platen cover 4.

An operation panel 8 is provided in front of the contact glass 6. The operation panel 8 is provided with a plurality of operation keys and switches that the operator uses for various operations and a display screen on which various types of information are displayed.

A sheet feeding cassette 12 is disposed at the bottom of the apparatus main body 2. The sheet feeding cassette 12 is formed to be attachable to and detachable from the apparatus main body 2 on the front side. When pulled out on the front side, the interior of the cassette 12 is opened to the outside. For example, a large number of standard sheets are stacked in the sheet feeding cassette 12.

Meanwhile, a sheet feeding device for manual sheet feeding is disposed above the sheet feeding cassette 12 on the front side of the apparatus main body 2. This sheet feeding device has a front cover 20 (cover) that covers the front side of the apparatus main body 2 and a sheet feeding unit 18 (sheet feeding unit). As is shown in FIG. 4, the front cover 20 is formed in the shape of a gate provided with an opening 201 (second opening) through which a sheet is manually fed. The lower end portion 21 of the front cover 20 is supported pivotally on a supporting point portion 20A (FIG. 3) at the bottom on the front side of the apparatus main body 2. A top portion 20U forms a part of the sheet discharging tray 36. The sheet feeding unit 18 is a unit used to manually feed sheets which are standard sheets or special sheets, such as thick paper.

The sheet feeding unit 18 has a manual tray 22 (sheet storing portion) on which the sheets are placed. The lower end portion 23 of the manual tray 22 (see FIG. 3) is supported pivotally on the apparatus main body 2 at the same position of the supporting point portion 20A in the lower end portion 21 of the front cover 20. When the operator grips a handle 26 and pulls the tray 22 forward from the front side of the MFP 1, the manual tray 22 is opened with respect to the front cover 20. When the manual tray 22 is opened, the opening 201 is opened to the outside (FIG. 4). The front cover 20 is provided with operation concave portions 20H at the upper positions on both the right and left side portions for an opening operation. When the operator inserts his or her fingers into the respective operation concave portions 20H and pulls the front cover 20 forward, the front cover 20 together with the manual tray 22 pivots about the supporting point portion 20A and is opened with respect to the apparatus main body 2. The interior of the apparatus main body 2 is thus opened to the outside by the operations as above.

Figure 2:
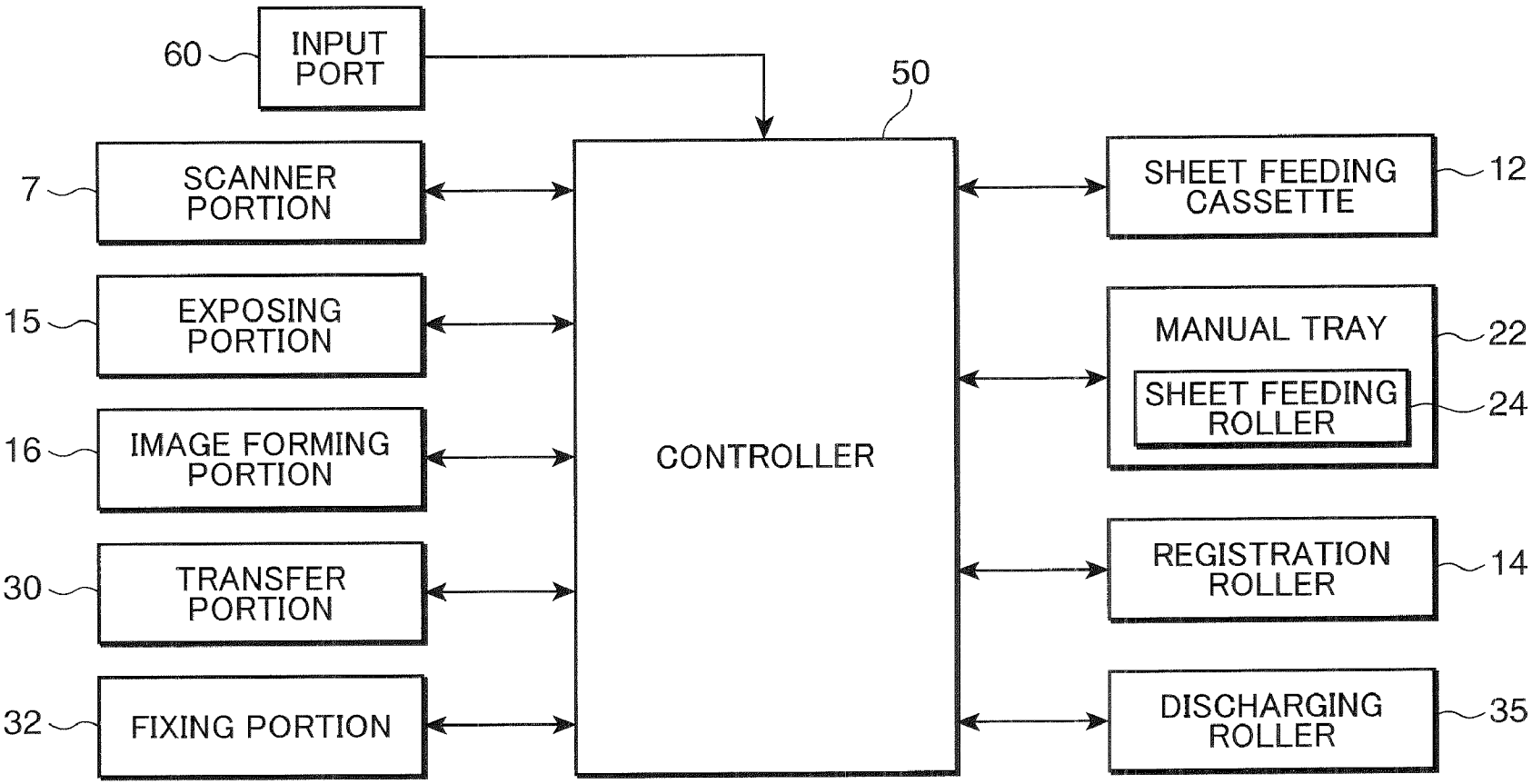
FIG. 2 is a block diagram schematically showing the configuration of the image forming apparatus.

FIG. 2 is a block diagram schematically showing the configuration of the image forming apparatus. In the interior of the apparatus main body 2, a registration roller 14, an image forming portion 16 (image forming unit), and a transfer portion 30 are sequentially disposed downstream of the sheet feeding cassette 12 and the manual tray 22 in the sheet feeding direction.

The image forming portion 16 includes an image carrier formed, for example, of a photoconductive drum, a charging device that uniformly charges the peripheral surface of the photoconductive drum, a developing device that supplies the peripheral surface of the photoconductive drum with toner particles, and so forth. An exposing portion 15 is provided in the vicinity of the image forming portion 16 and a laser beam is irradiated from the exposing portion 15 toward the peripheral surface of the photoconductive drum.

The transfer portion 30 has a transfer roller and the transfer roller is formed so that it can be pressed against the photoconductive drum. The transfer roller and the photoconductive drum together form a nip portion in which a toner image formed on the peripheral surface of the photoconductive drum is transferred onto a sheet.

Also, a fixing portion 32 and a discharging roller 35 are sequentially disposed downstream of the transfer portion 30 in the sheet feeding direction. The fixing portion 32 includes fixing rollers that heat and press a sheet bearing a transferred toner image. The discharging roller 35 is a roller that discharges a sheet after the fixing process onto the sheet discharging tray 36.

When the MFP 1 performs printing, sheets in the sheet feeding cassette 12 or sheets on the manual tray 22 are separated one by one and sent out. A sheet sent out in this manner, reaches the registration roller 14. The registration roller 14 sends out the sheet to the transfer portion 30 while correcting sheet skew feeding and matching the image transfer timing for a toner image formed in the image forming portion 16.

The MFP 1 includes an input port 60. The input port 60 is a port that receives from an external device or the scanner portion 7 the image data according to which printing is executed. The image data referred to herein is various images of characters, signs, figures, symbols, diagrams, patterns, and so forth in the form of data. The controller 50 controls irradiation of a laser beam according to this data.

The controller 50 is an element functioning as a computer and has hardware resources, such as a CPU and a memory. The controller 50 runs a predetermined program using these hardware resources, so that an electrostatic latent image of the document image is formed on the photoconductive drum and a toner image corresponding to this electrostatic latent image is formed subsequently in the image forming portion 16.

The structures of the front cover 20 and the sheet feeding unit 18 will now be described in detail with reference to FIG. 3 through FIG. 6B. The apparatus main body 2 is provided with an opening 17 (first opening) at the top position on the front side. The units consisting of the image forming portion 16 are attached to and detached from the apparatus main body 2 through this opening 17. Examples of the units consisting of the image forming portion 16 include but not limited to a photoconductive drum unit, a developing unit, and a toner container.

Figure 6B:
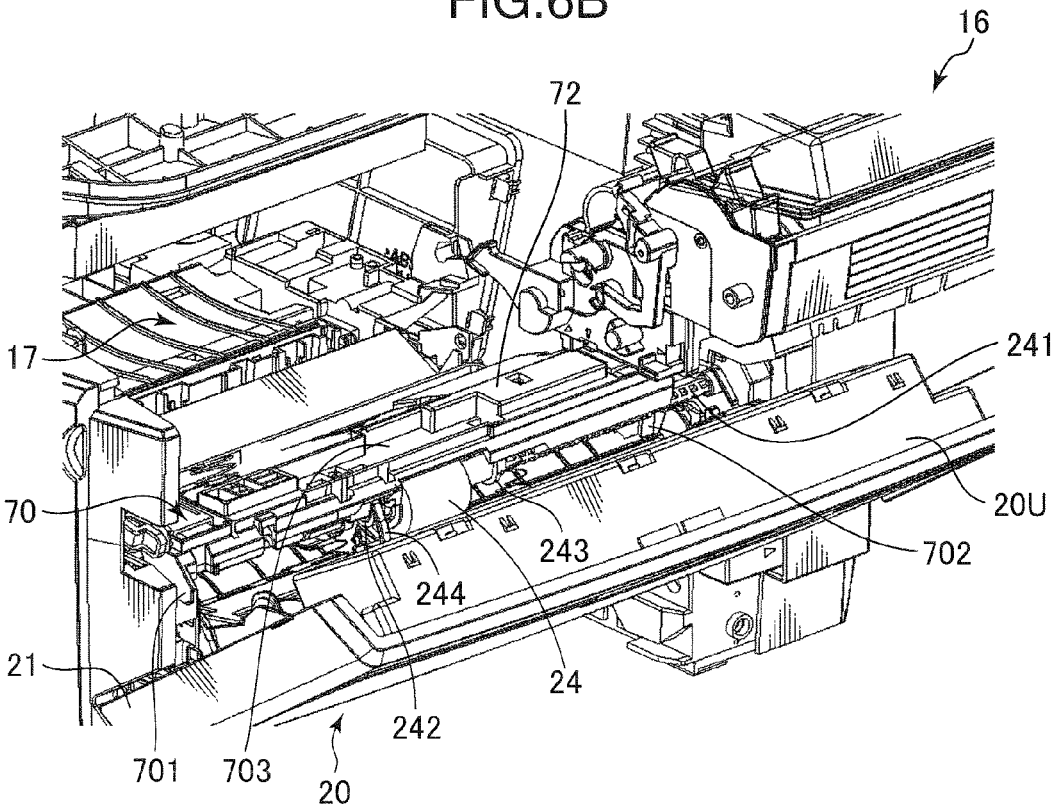

As is shown in FIG. 1, the front cover 20 is able to change its posture between a closing posture (first posture) at which it is entirely engaged with the apparatus main body 2 on the front side and thereby covers the opening 17 and, as are shown in FIG. 6A and FIG. 6B, an opening posture (second posture) at which it pivots about the supporting point portion 20A so that the upper end thereof is spaced apart from the apparatus main body 2 and thereby opens the opening 17. In other words, when the front cover 20 is at the closing posture, the opening 17 is not visually confirmed from the outside because it is covered with the front cover 20 (FIG. 3), and when it is at the opening posture and the interior of the apparatus main body 2 is opened, the opening 17 is visually confirmed from the front side of the MFP 1 (FIG. 6A and FIG. 6B). Further, because the top portion 20U of the front cover 20 that forms the front edge portion of the sheet discharging tray 36 is opened, too, the operator is able to visually confirm the interior of the apparatus main body 2 from diagonally above the MFP 1, which facilitates attachment and detachment of the units.

Accordingly, at the replacement or the maintenance of the units consisting of the image forming portion 16, the front cover 20 is set to the opening posture. A deflection restricting portion 80 (housing supporting portion) described below is provided to the front cover 20 at the position opposing the opening 17. While the front cover 20 is at the closing posture, the deflection restricting portion 80 substantially covers the opening portion 17.

Figure 3:
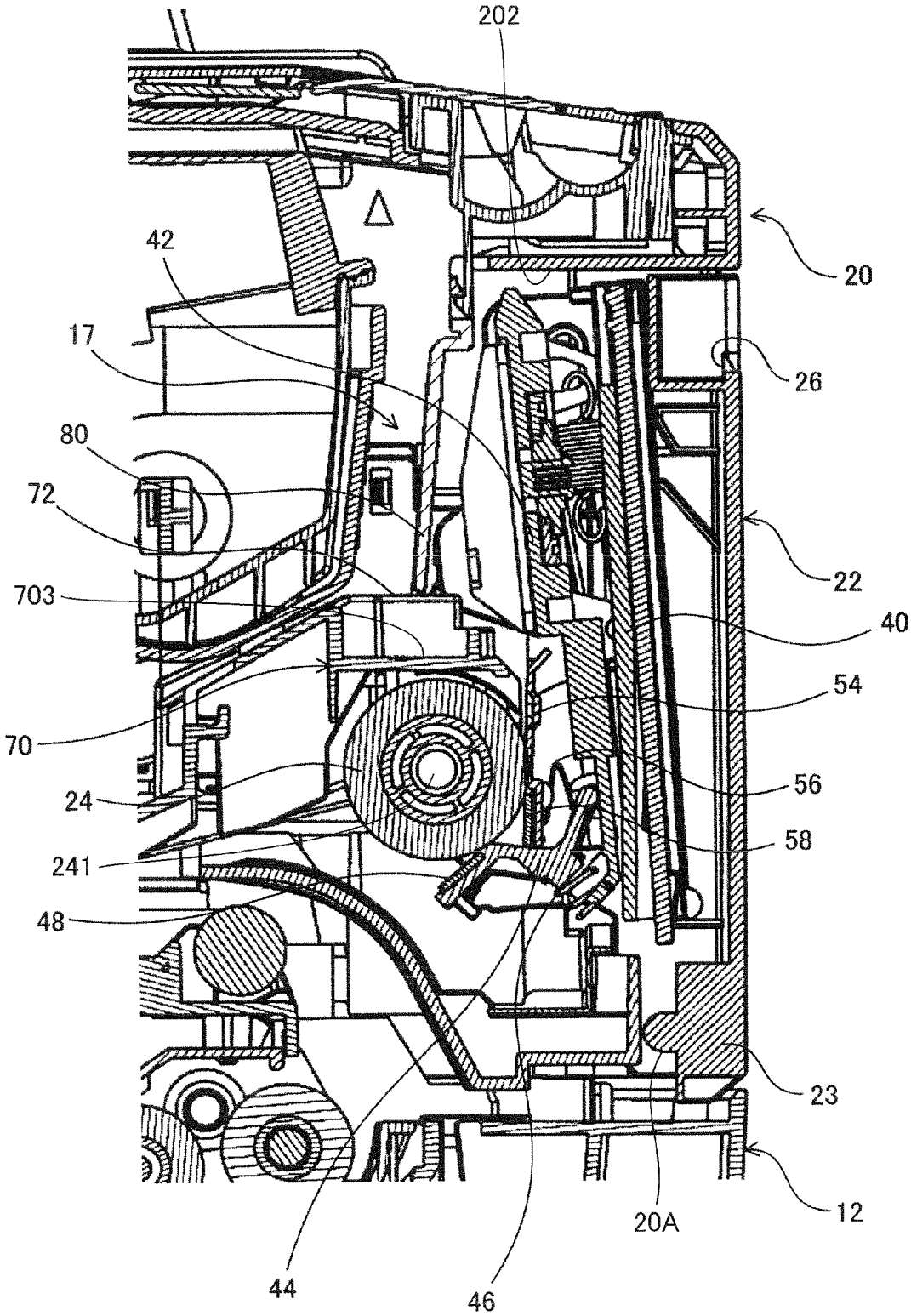
FIG. 3 is a sectional view of a major portion of FIG. 1 showing a state where a manual tray is closed.
Figure 4:
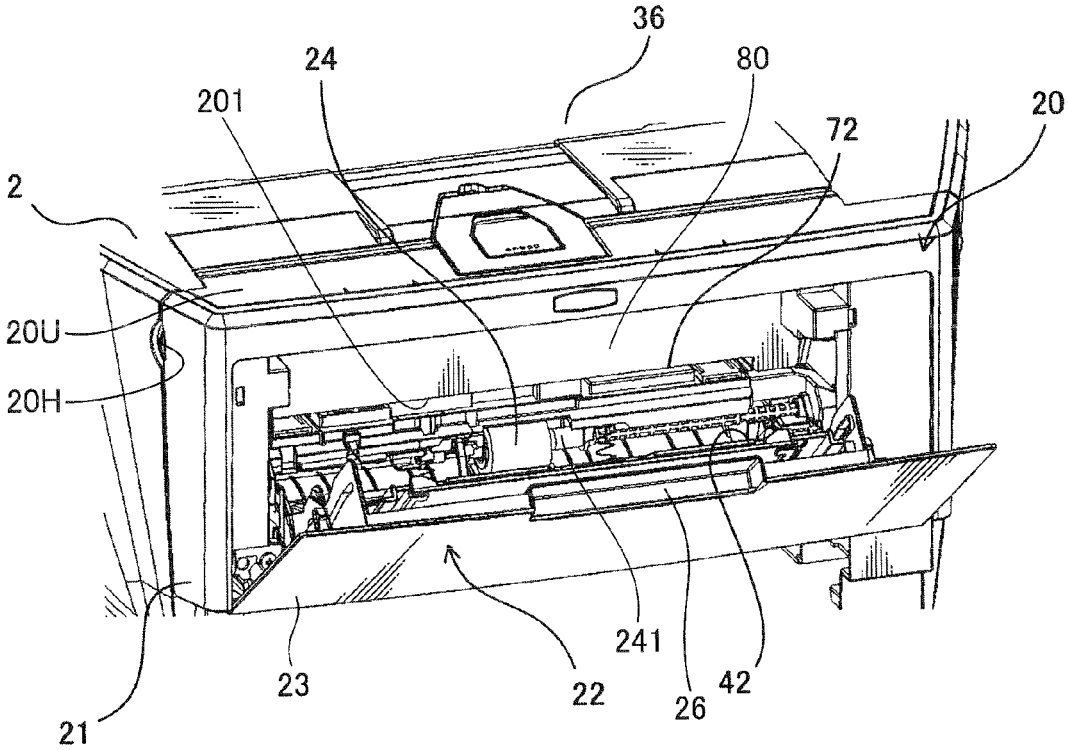
FIG. 4 is a perspective view of the major portion of FIG. 1 showing a state where the manual tray is opened.
Figure 5:
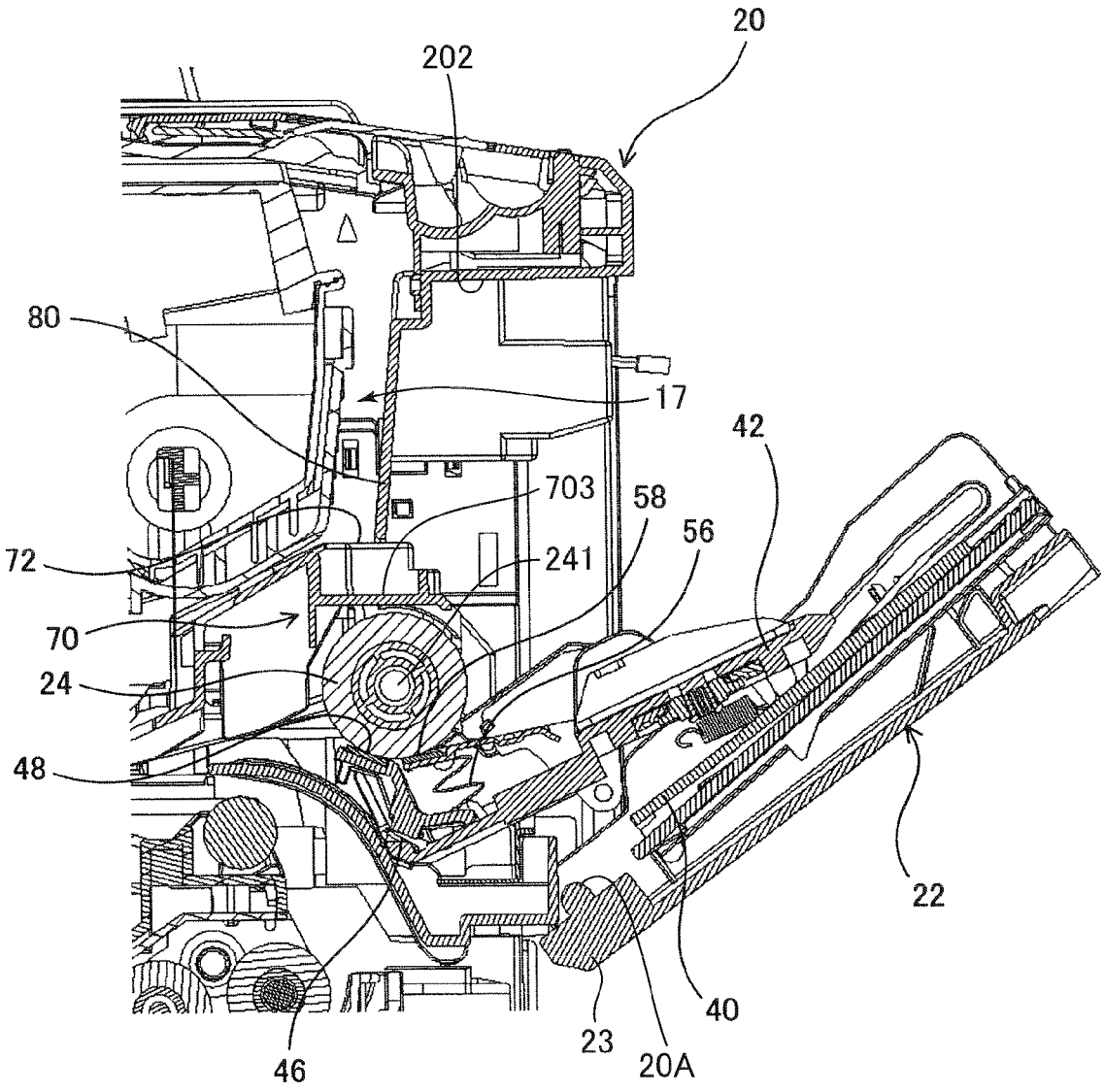
FIG. 5 is a sectional view of the major portion of FIG. 1 showing a state where the manual tray is opened.

As are shown in FIG. 3 through FIG. 5, the manual tray 22 is able to change its posture between a closing posture (third posture) at which it covers an opening 201 in the front cover 20 and an opening posture (fourth posture) at which it opens the opening 201. A base stand 40 is formed between the lower end portion 23 and the handle 26 behind the manual tray 22. A sheet feeding tray portion 42 is mounted on the base stand 40. FIG. 4 and FIG. 5 show the manual tray 22 at the opening posture and one or more than one sheet is placed on the sheet feeding tray portion 42 in this state.

A separating member 44 and a lifting plate 54 are provided to the sheet feeding tray portion 42 on the lower end side. A friction pad 48 is attached to the separating member 44 and the friction pad 48 is pushed toward the sheet feeding roller 24 by a spring 46. A sheet feeding pad 58 is attached to the lifting plate 54 and the sheet feeding pad 58 is pushed toward the sheet feeding roller 24 by a spring 56. This configuration enables a separating nip portion to be defined between the sheet feeding roller 24 and the friction pad 48 and a sheet feeding nip portion to be defined between the sheet feeding roller 24 and the sheet feeding pad 58.

A multi-frame 70 (housing) having a housing structure is disposed below the opening 17 of the apparatus main body 2. The multi-frame 70 is made of resin (for example, ABS resin) and is formed in the shape of a gate smaller than the front cover 20. It includes pillar portions 701 and 702 on right and left and a beam portion 703 connecting the top portions of these pillar portions 701 and 702 (see FIG. 6B). The multi-frame 70 is screwed to the bottom and the right and left side of the apparatus main body 2.

The right end portion of the sheet feeding roller 24 is coupled to a drive shaft 241 extending from the right side of the apparatus main body 2. Meanwhile, the left end portion of the sheet feeding roller 24 is coupled to a supporting shaft 242. The drive shaft 241 and the supporting shaft 242 are axially supported, respectively, on axially supporting portions 243 and 244 extending from the beam portion 703 of the multi-frame 70 in a rotatable manner in the vicinity of the sheet feeding roller 24. The sheet feeding roller 24 is rotated by the drive shaft 241 to which a rotational drive force is given from a drive gear provided to the apparatus main body 2.

The opening 17 is formed in the apparatus main body 2 on the front side between a beam portion 202 of the gate-shaped front cover 20 and the beam portion 703 connecting the pillar portions 701 and 702 of the multi-frame 70 along the right-left direction of the MFP 1. The opening 17 is a space provided above the sheet feeding roller 24 (beam portion 703), through which the image forming portion 16 is attached to and detached from the interior of the apparatus main body 2 from diagonally above on the front side, and it is normally closed with the front cover 20.

The top 72 of the beam portion 703 of the multi-frame 70 abuts on the deflection restricting portion 80 of the front cover 20. The deflection restricting portion 80 of this embodiment is a flat-plate member extending downward from the inner end edge of the beam portion 202 of the front cover 20 and is almost as wide as the beam portion 202 in the horizontal direction. While the front cover 20 is at the closing posture, the lower end edge of the deflection restricting portion 80 abuts on the top 72 of the beam portion 703 at more than one point. It should be appreciated, however, that the lower end edge of the deflection restricting portion 80 does not necessarily have to abut on the top 72 while the manual tray 22 is closed and a slight clearance may be left between the lower end edge and the top 72.

When the operator is to feed sheets manually, as is shown in FIG. 4, the operator sets the manual tray 22 to the opening posture while leaving the front cover 20 at the closing posture. Accordingly, the sheet feeding tray portion 42 is opened to the outside. Subsequently, the operator places sheets on the tray portion 42 and aligns a width of the sheets by using cursors.

When feeding operation of the sheets starts after the manual tray 22 is opened and the sheets are stacked, the pads 48 and 58 (the separating member 44 and the lifting plate 54) push the sheet feeding roller 24 upward because of pushing forces of the springs 46 and 56. This gives rise to a force with which the multi-frame 70 undergoes a deflection in a direction to escape from the separating member 44 and the lifting plate 54. However, because the front cover 20 is at the closing posture, the deflection restricting portion 80 abuts on the top 72 of the multi-frame 70. Flexural deformation of the multi-frame 70 is thus restricted.

To be more specific, as is shown in FIG. 5, the lower end portion of the deflection restricting portion 80 abuts on the frame 70 at a position above the rotation shaft line of the sheet feeding roller 24, that is, at a position on the opposite side of the contact points between the roller 24 and the pads 48 and 58 (the separating nip portion and the sheet feeding nip portion) with the rotation shaft line of the roller 24 in between, that is, at the position of the top 72. Therefore deflection of the frame 70 is thus restricted.

Accordingly, the sheet feeding roller 24 will not escape upward even when the manual tray 22 is used. Consequently, even when a transportation roller is not additionally provided between the sheet feeding roller 24 and the registration roller 14, an appropriate feeding force is secured stably by the sheet feeding roller 24 and the pads 48 and 58 that are pressed against each other for sheets to be fed from the manual tray 22. The sheets are therefore sent out toward the registration roller 14.

The deflection restricting portion 80 is provided to the front cover 20. The front cover 20 is supported pivotally on the apparatus main body 2 at the supporting point portion 20A in the lower end portion 21 on the outer side of the position at which the deflection restricting portion 80 is formed. Accordingly, when the front cover 20 is set to the opening posture, the deflection restricting portion 80 also moves together with the front cover 20. Hence, as are shown in FIGS. 6A and 6B, it becomes possible to pull out, for example, the units forming the image forming portion 16, swiftly from the apparatus main body 2 via the opening 17.

As has been described, this embodiment focuses attention on a point that the front cover 20 itself supports the multi-frame 70. The apparatus main body 2 is provided with the opening 17 in the interior thereof and the image forming portion 16 is configured to be attachable to and detachable from the apparatus main body 2 via the opening 17. In addition, the opening 17 is covered with the front cover 20 and the sheet feeding unit 18 is disposed below the opening 17. The unit 18 includes the manual tray 22 having the separating member 44 and the lifting plate 54 and the sheet feeding roller 24.

A feeding force, which is generated by the sheet feeding roller 24 and the pads 48 and 58 of the separating member 44 and the lifting plate 54 that are pressed against each other, is given to sheets placed on the manual tray 22 and each sheet is fed toward the registration roller 14. Herein, the deflection restricting portion 80 of the front cover 20 abuts on the multi-frame 70 supporting the sheet feeding roller 24.

Deflection of the frame 70 occurring when sheets are fed is thus restricted. Hence, contrarily to the conventional case, it becomes possible to obtain an appropriate feeding force. Consequently, even when special sheets on the manual tray 22 are fed, sheet jamming between the sheet feeding roller 24 and the registration roller 14 can be prevented. The reliability of the MFP 1 can be thus enhanced.

Moreover, the deflection restricting portion 80 is provided to the front cover 20. Hence, contrarily to a case where a reinforcing member different from the front cover 20 is provided to the frame 70, the deflection restricting portion 80 will not lie in the way when the image forming portion 16 is pulled out from the apparatus main body 2 via the opening 17. This configuration therefore contributes to space saving of the MFP 1 and making the MFP 1 easier to operate. Further, because the number of components and the number of fabrication steps are not increased, this configuration contributes also to making the MFP 1 cheaper.

Pressures from the separating member 44 and the lifting plate 54 act on the sheet feeding roller 24. However, because the deflection restricting portion 80 abuts on the multi-frame 70 at the position on the opposite side of the contact point of the sheet feeding roller 24 and the pads 48 and 58, flexural deformation of the multi-frame 70 can be restricted in a reliable manner.

Further, the pivotal supporting point of the front cover 20 is on the outer side of the position at which the deflection restricting portion 80 is formed while the front cover 20 is closed. Accordingly, the multi-frame 70 will not interfere with an opening path of the front cover 20. This configuration enables the operator to set the front cover 20 to the opening posture without any interference with the multi-frame 70.

Using ABS resin as a material of the multi-frame 70 is advantageous because it can be molded easily at a low cost in comparison with hard materials, such as metal or other types of resin. Even when the multi-frame 70 is made of such a material, because the deflection restricting portion 80 described above supports the frame 70 made of soft resin, deflection can be suppressed notably.

It should be appreciated that the invention is not limited to the embodiment above and various modifications are possible without deviating from the scope of appended claims. For example, the respective configurations of the embodiment above may be omitted in part or combined optionally in different manners. The embodiment above described a case where the image forming apparatus is implemented as a MFP. It goes without saying, however, that the invention is also applicable to a copying machine, a printer, a facsimile machine, and so forth.

The specific embodiment described above chiefly includes inventions having the following configurations.

An image forming apparatus according to an aspect of the invention includes: an apparatus main body provided with an opening; an image forming unit for forming an image while being attachable to and detachable from the apparatus main body via the opening; a cover supported pivotally on the apparatus main body so as to cover the opening; and a sheet feeding unit disposed below the opening, including a sheet storing portion supported pivotally on the apparatus main body for stacking sheets thereon, a lifting plate held in the sheet storing portion to be movable up and down, a sheet feeding roller pressed against the lifting plate and feeding a sheet on the sheet storing portion toward inside the apparatus main body, and a housing on which to support the sheet feeding roller in a rotatable manner. The cover has a housing support portion that abuts on the housing from above the housing when the cover is in a closed state.

According to this configuration, a feeding force generated by the sheet feeding roller and the lifting plate that are pressed against each other is given to a sheet and the sheet is fed toward inside the apparatus main body. Herein, the housing supporting portion of the cover abuts on the housing that supports the sheet feeding roller. Accordingly, even when the lifting plate is pressed against the sheet feeding roller, deflection of the housing occurring during the feeding of a sheet is restricted. Hence, contrarily to the conventional case, it becomes possible to obtain an appropriate feeding force. Accordingly, even when a sheet in the sheet storing portion is fed, sheet jamming in the vicinity of the sheet feeding roller can be prevented. The reliability of the image forming apparatus can be thus enhanced.

Moreover, the housing supporting portion is provided to the cover. Hence, contrarily to a case where a separate reinforcing member is provided to the housing, the housing supporting portion will not lie in the way when the image forming unit is pulled out from the apparatus main body via the opening. This configuration therefore contributes to space saving of the image forming apparatus and making the image forming apparatus easier to operate. Further, the number of components and the number of fabrication steps are not increased. Accordingly, this configuration also contributes to making the image forming apparatus cheaper.

In the configuration above, it is preferable that the housing supporting portion abuts on the housing at a position on an opposite side of a contact point of the sheet feeding roller and the lifting plate with an axial line of the sheet feeding roller in between when the cover is in a closed state. According to this configuration, a pressure from the lifting plate acts on the sheet feeding roller. However, because housing supporting portion abuts on the housing at the position on the opposite side of the contact point of the sheet feeding roller and the lifting plate, flexural deformation of the housing can be restricted in a reliable manner.

In the configuration above, it is preferable that the cover is supported pivotally on the apparatus main body at a position present on an outer side of a position at which the housing supporting portion is formed when the cover is in a closed state. According to this configuration, it is possible to pivot the cover without any interference with the housing.

In the configuration above, it is preferable that the housing is made of resin. According to this configuration, the housing made of soft resin can be molded easily at a low cost in comparison with a hard material, such as metal. Moreover, because the housing support portion supports the housing made of resin, deflection thereof is suppressed notably.

An image forming apparatus according to another aspect of the invention includes: an apparatus main body configured to accommodate units for image formation and provided with a first opening through which at least a part of the units are attached to and detached from an interior thereof; a cover provided with a second opening through which a sheet is fed and a deflection restricting portion, supported pivotally on the apparatus main body at a lower end portion thereof, and configured to be able to change a posture between a first posture for covering the first opening and a second posture for opening the first opening; a tray supported pivotally on the apparatus main body at a lower end portion thereof and configured to be able to change a posture between a third posture for covering the second opening and a fourth posture for opening the second opening so that sheets are placed thereon at the fourth posture; a sheet feeding roller for feeding a sheet on the tray at the fourth posture to the inside of the apparatus main body; and a housing disposed below the first opening, supporting the sheet feeding roller thereon in a rotatable manner, and having an abutting portion on which the deflection restricting portion abuts when the cover is at the first posture.

According to this configuration, for the housing that supports the sheet feeding roller, flexural deformation can be restricted by the deflection restricting portion abutting thereon. Hence, the position of the sheet feeding roller will not vary and a stable sheet feeding force can be obtained.

In the configuration above, it is preferable to further include a lifting plate pressed against the sheet feeding roller so as to form a sheet feeding nip with the sheet feeding roller.

In this case, it is preferable that the lifting plate is pressed against the sheet feeding roller from a lower side, and that the abutting portion is disposed on a top of the housing and the deflection restricting portion restricts upward deflection of the housing by abutting on the abutting portion from above.

This application is based on Japanese Patent Application Serial No. 2008-060536, filed in Japan Patent Office on Mar. 11, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an apparatus main body provided with an opening;

an image forming unit for forming an image while being attachable to and detachable from the apparatus main body via the opening;

a cover supported pivotally on the apparatus main body so as to cover the opening; and a sheet feeding unit disposed below the opening, including a sheet storing portion supported pivotally on the apparatus main body for stacking sheets thereon, a lifting plate held in the sheet storing portion to be movable up and down, a sheet feeding roller disposed for feeding a sheet on the sheet storing portion toward inside the apparatus main body, a biasing member pressing the lifting plate against the sheet feeding roller, and a housing supporting the sheet feeding roller in a rotatable manner, wherein the cover has a housing support portion that abuts on the housing from above the housing when the cover is in a closed state.

2. The image forming apparatus according to claim 1, wherein:

the housing supporting portion abuts on the housing at a position on an opposite side of a contact point of the sheet feeding roller and the lifting plate with an axial line of the sheet feeding roller in between when the cover is in a closed state.

3. The image forming apparatus according to claim 1, wherein:

the cover is supported pivotally on the apparatus main body at a position present on an outer side of a position at which the housing supporting portion is formed when the cover is in a closed state.

4. The image forming apparatus according to claim 1, wherein:

the housing is made of resin.

5. An image forming apparatus, comprising:

an apparatus main body configured to accommodate units for image formation and provided with a first opening through which at least a part of the units are attached to and detached from an interior thereof;

a cover provided with a second opening through which a sheet is fed and a deflection restricting portion, supported pivotally on the apparatus main body at a lower end portion thereof, and configured to be able to change a posture between a first posture for covering the first opening and a second posture for opening the first opening;

a tray supported pivotally on the apparatus main body at a lower end portion thereof and configured to be able to change a posture between a third posture for covering the second opening and a fourth posture for opening the second opening so that sheets are placed thereon at the fourth posture, the tray having a lifting plate on which the sheet is placed and that is movable up and down;

a sheet feeding roller for feeding the sheet on the lifting plate of the tray at the fourth posture to the inside of the apparatus main body;

a biasing member pressing the lifting plate against the sheet feeding roller; and a housing disposed below the first opening, supporting the sheet feeding roller in a rotatable manner, and having an abutting portion on which the deflection restricting portion abuts when the cover is at the first posture.

6. The image forming apparatus according to claim 5, wherein:

the lifting plate is pressed against the sheet feeding roller from a lower side; and the abutting portion is disposed on a top of the housing and the deflection restricting portion restricts upward deflection of the housing by abutting on the abutting portion from above.

* * * * *